US006454108B1

(12) United States Patent
Gerard

(10) Patent No.: US 6,454,108 B1
(45) Date of Patent: Sep. 24, 2002

(54) LOW-PROFILE MOBILE STORAGE RACK

(76) Inventor: Geoffrey A. Gerard, 8439 San Leandro Dr., Dallas, TX (US) 75218

( * ) Notice: Subject to any disclaimer, the term of this patent is extended or adjusted under 35 U.S.C. 154(b) by 0 days.

(21) Appl. No.: 09/730,446

(22) Filed: Dec. 5, 2000

(51) Int. Cl.[7] ..... A47B 73/00
(52) U.S. Cl. ..... 211/74
(58) Field of Search ..... 211/74; D6/513

(56) References Cited

U.S. PATENT DOCUMENTS

| | | | | | |
|---|---|---|---|---|---|
| 2,213,918 | A | * | 9/1940 | Lofstrand, Jr. | 211/74 X |
| 2,572,090 | A | * | 10/1951 | Allen | 211/74 X |
| 2,975,906 | A | * | 3/1961 | Van der Togt | 211/74 |
| 4,071,258 | A | * | 1/1978 | Wallace | 280/79.2 |
| 4,327,836 | A | | 5/1982 | Okuno | |
| 4,700,849 | A | | 10/1987 | Wagner | |
| 4,756,119 | A | * | 7/1988 | Chabot | 211/71.01 X |
| 5,241,718 | A | * | 9/1993 | Pope | 5/424 |
| 5,460,277 | A | | 10/1995 | Silva | |
| 5,551,715 | A | | 9/1996 | Pickard | |
| 5,611,554 | A | | 3/1997 | Eckloff | |
| 5,695,205 | A | | 12/1997 | Liu | |
| D393,388 | S | * | 4/1998 | Chen | D6/513 |
| D420,834 | S | * | 2/2000 | Anderson | D6/449 |

FOREIGN PATENT DOCUMENTS

DE 298 06 539 U1 * 8/1998

* cited by examiner

*Primary Examiner*—Daniel P. Stodola
*Assistant Examiner*—Erica B Harris
(74) *Attorney, Agent, or Firm*—Akin, Gump, Strauss, Hauer & Feld, LLP

(57) ABSTRACT

A low-profile storage rack is provided for supporting and storing a plurality of containers. The rack includes a frame having a first longitudinal beam, a second longitudinal beam spaced from the first longitudinal beam, a first transverse beam connected to the first and second longitudinal beams, and a second transverse beam spaced from the first transverse beam and connected to the first and second longitudinal beams. Casters are positioned on an underside of the frame for moving the rack between storage and access positions. A plurality of sets of rods are located in an opening formed between the beams and extend between the longitudinal beams. A distance between adjacent sets of rods is less than a distance between adjacent rods of each set such that adjacent containers can be supported above a floor or other surface on adjacent sets of rods.

20 Claims, 3 Drawing Sheets

LOW-PROFILE MOBILE STORAGE RACK

BACKGROUND OF THE INVENTION

1. Field of the Invention

This invention relates to storage racks, and more particularly to a low profile storage rack for bottles or other items that can be moved between storage and access positions.

2. Description of the Related Art

Wine often is stored in a cool dark location, with the bottles lying on their sides to prevent drying of the cork or stopper. Wine racks typically include horizontally extending compartments that receive the bottles. The compartments are usually arranged in a three-dimensional matrix of rows and columns so that a large number of bottles may be stored. Generally, such structures are bulky, particularly if provision for the storage of several bottles is provided, and are usually permanently mounted to a wall or other structure to accommodate the combined weight of the rack and bottles. In environments where storage or wall space is limited, the use of these types of racks is often prohibited or compromised.

It is therefore an object of the present invention to provide a storage rack for bottles or other items that can be positioned in relatively small, unobtrusive areas that are usually occupied by furniture or the like.

SUMMARY OF THE INVENTION

According to the invention, a low-profile storage rack for supporting and storing containers thereon, includes a frame having: a first longitudinal beam; a second longitudinal beam spaced from the first longitudinal beam; and at least a first transverse beam connected to the first and second longitudinal beams. At least one set of rods extends from one of the first and second longitudinal beams toward the other of the first and second longitudinal beams. The rods are spaced from each other to thereby support at least one container thereon.

According to a further embodiment of the invention, a low-profile storage rack is provided for supporting and storing a plurality of containers thereon. The rack includes a frame having: a first longitudinal beam; a second longitudinal beam spaced from the first longitudinal beam; a first transverse beam connected to the first and second longitudinal beams; and a second transverse beam spaced from the first transverse beam and connected to the first and second longitudinal beams. The longitudinal and transverse beams together form an opening. A plurality of sets of rods are located in the opening and extend from one of the first and second longitudinal beams toward the other of the first and second longitudinal beams. A distance between adjacent sets of rods is less than a distance between adjacent rods of each set such that a main body portion of adjacent containers can be supported on adjacent sets of rods.

BRIEF DESCRIPTION OF THE DRAWINGS

The preferred embodiments of the present invention will hereinafter be described in conjunction with the appended drawings, wherein like designations denote like elements, and wherein.

It is noted that the drawings are intended to depict only typical embodiments of the invention, and therefore should not be considered as limiting the scope thereof. The invention will now be described in greater detail with reference to the drawings.

DETAILED DESCRIPTION OF THE PREFERRED EMBODIMENTS

Figure 1:
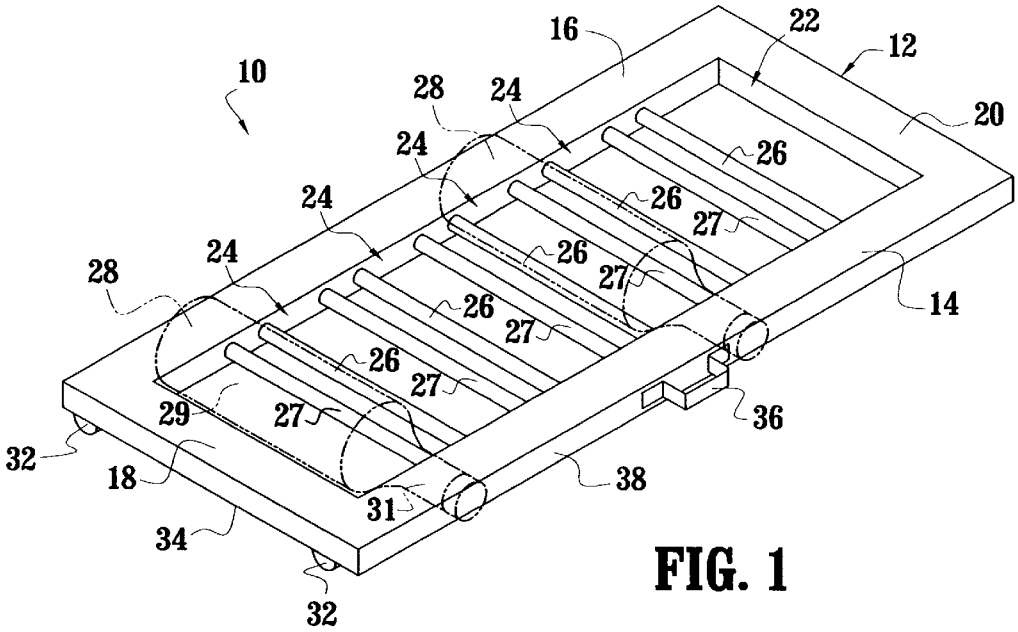
FIG. 1 is an isometric view of a low-profile mobile storage rack according to a first embodiment of the invention.
Figure 2:
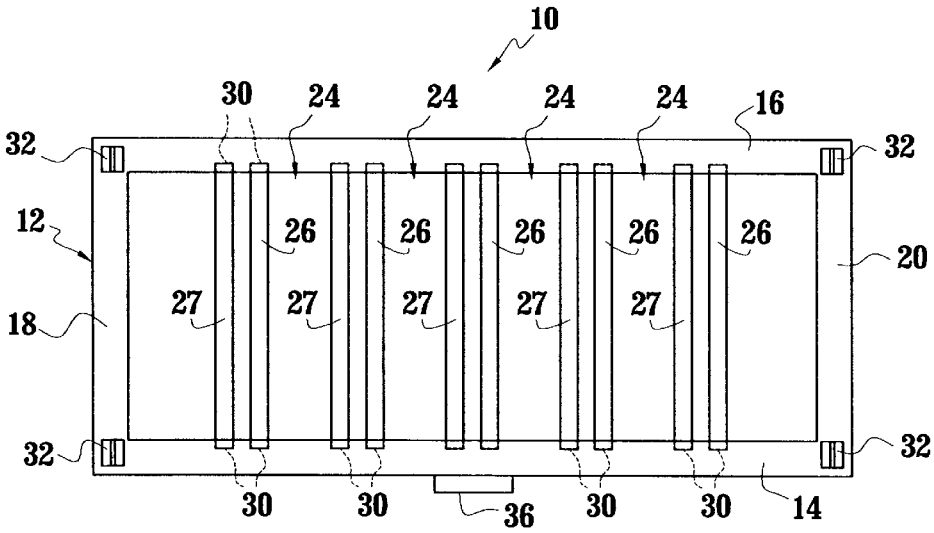
FIG. 2 is a bottom plan view of the rack of FIG. 1.

Referring now to the drawings, and to FIGS. 1 and 2 in particular, a low-profile mobile storage rack 10 according to the invention is illustrated. The rack 10 includes a frame 12 with longitudinal beams 14, 16 and cross beams 18, 20 connected to the ends of the longitudinal beams to thereby form a frame opening 22. Preferably, the longitudinal beams 14, 16 are substantially parallel to each other and the cross beams 18, 20 extend substantially perpendicular to the longitudinal beams.

Sets 24 of rods 26 and 27 are located in the opening 22 and extend between the longitudinal beams 14, 16. Each set 24 preferably includes a pair of rods 26 and 27 that extend substantially parallel to the cross beams 18, 20. The rods 26 and 27 of each set 24 are spaced a sufficient distance to support a bottle 28 (shown in phantom line in FIG. 1), such as a wine bottle or other container or item, above a floor or other surface. The sets 24 are spaced from each other a sufficient distance so that adjacent bottles 28 may be supported on adjacent sets 24. Preferably, a distance between adjacent sets 24 of rods is less than a distance between adjacent rods of each set. One rod 27 and the transverse beam 18 are also spaced a sufficient distance to receive and support a bottle or other container therebetween. Likewise, one rod 26 and the transverse beam 20 are spaced a sufficient distance to receive and support a bottle or other container therebetween.

Although the rods 26 and 27 may be of any desired shape, they are preferably cylindrical in shape to thereby ensure minimal contact between the bottle 28 and the rods. In this manner, the bottles may be turned about their respective axes with minimal friction to thereby mix the contents of the bottle from time to time, which may be desirable for certain beverages.

The opening 22 is preferably dimensioned so that a main portion 29 of the bottles 28 is coincident with the opening while a neck portion 31 of the bottles 28 extends over one of the longitudinal beams 14, 16, depending on the orientation of the bottles 28 on the rack 10.

The storage rack 10, including the frame 12 and rods 26 and 27, may be constructed of wood, metal, plastic, fiberglass or other composites, or any combination thereof. In a preferred embodiment, the frame 12 and rods 26 and 27 are constructed of wood, with each of the beams 14–20 being formed separately and joined together. The ends of each beam preferably form a 45° angle (not shown) and are joined with an end of an adjacent beam so that the opening 22 is substantially square or rectangular in shape. As best shown in FIG. 2, aligned bores 30 are formed in the longitudinal beams 14, 16. The bores 30 receive the rods 26 and 27 during assembly of the frame. The frame 12 and rods 26 and 27 may be secured together through suitable fasteners, adhesive, or a combination thereof.

According to a further embodiment of the invention, the frame 12 and/or rods 26 and 27 may be integrally formed as a single piece of plastic or other material.

Casters or wheels 32 are preferably mounted to the underside 34 of the frame 12 at the intersections of the longitudinal beams 14, 16 and cross beams 18, 20. All of the wheels 32 preferably rotate about a wheel axis and an axis perpendicular to the wheel axis to thereby facilitate maneuverability of the rack 10. In a further embodiment, two of the wheels may be stationary with respect to the perpendicular axis. In yet a further embodiment, all of the wheels may be stationary with respect to the perpendicular axis. Although not shown, a brake may be associated with one or more of the wheels 32 in a well-known manner to lock the rack 10 in a stationary position when not in use.

A handle 36 is mounted to an outer edge or side 38 of the longitudinal beam 14. The handle 36 can be grasped by a user and, together with the wheels 32, facilitate movement of the rack 10 between storage and access positions.

The height of the rack 10, including the wheels 32, is preferably sufficiently smaller than the height between the floor and a bed rail, lower surface of a desk or other furniture, shelf, and the like, so that bottles or other containers or items located on the rack can be conveniently stored in a horizontal position under a bed, desk, or other furniture or the like, where space is normally not used.

Figure 3:
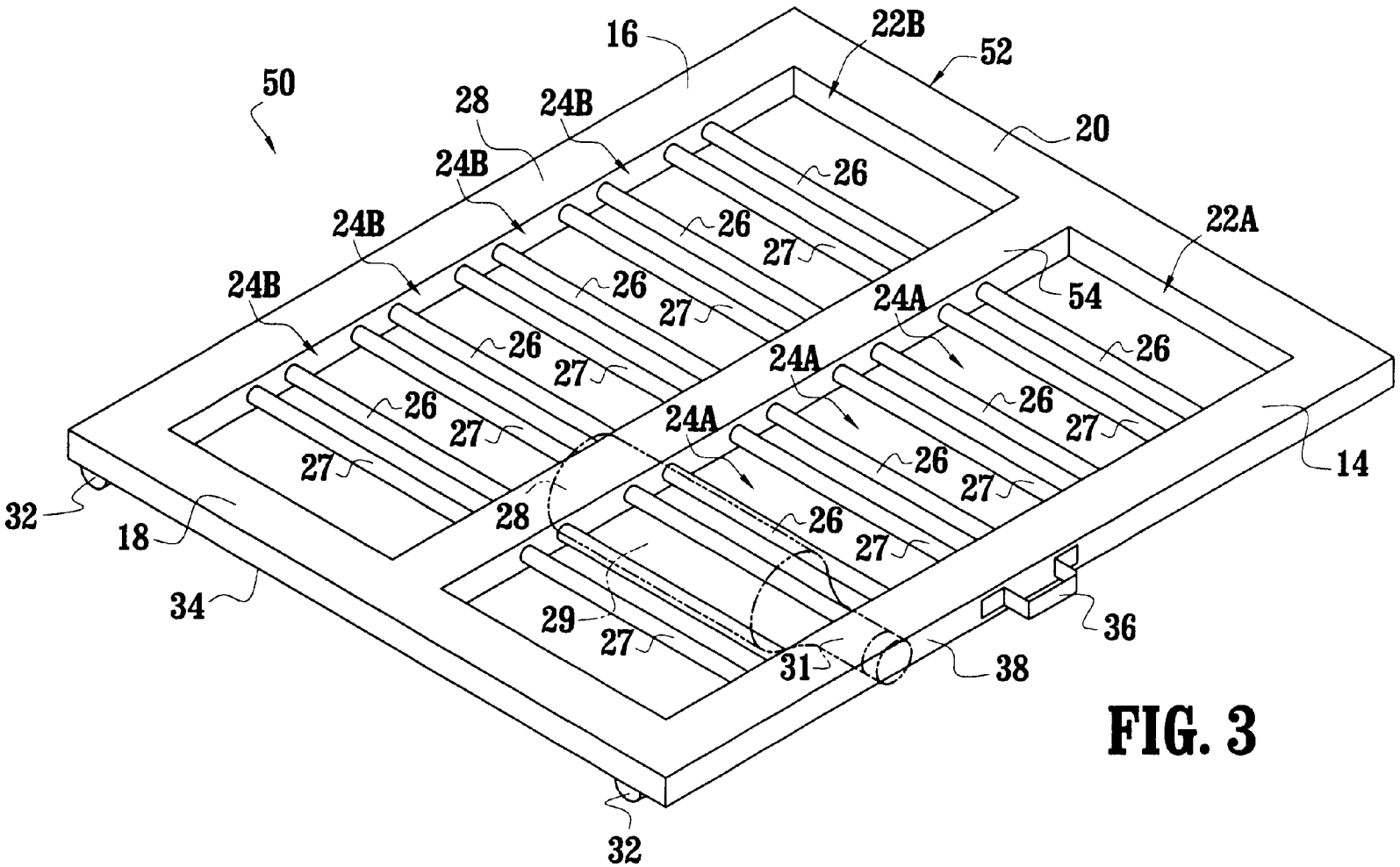
FIG. 3 is an isometric view of a mobile low-profile storage rack according to a second embodiment of the invention.

With reference now to FIG. 3, a low-profile mobile storage rack 50 according to a second embodiment of the invention is illustrated, wherein like parts in the previous embodiment are represented by like numerals. The rack 50 includes a frame 52 with longitudinal beams 14, 16 and cross beams 18, 20 connected to the ends of the longitudinal beams. A middle longitudinal beam 54 is preferably centrally located between and substantially parallel to the beams 14, 16, and extends between the cross beams 18, 20. The middle beam 54 together with the beams 14–20 form two openings 22A and 22B.

First sets 24A of rods 26 and 27 extend in the opening 22A between the longitudinal beam 14 and the middle beam 54. Likewise, second sets 24B of rods 26 and 27 extend in the opening 22B between the middle beam 54 and the longitudinal beam 16. The first sets 24A are preferably collinear with the second sets 24B as shown, but may be offset.

Each opening 22A, 22B is preferably similar in shape and dimension to the opening 22 in the FIG. 1 embodiment, so that the main portion 29 of the bottles 28 are coincident with the openings 22A, 22B while the neck portion 31 extends over one of the longitudinal beams 14, 16, or 54. Preferably, the bottles coincident with the opening 22A are oriented with their respective neck portions 31 extending over the beam 14, while the bottles coincident with the opening 22B are oriented with their respective neck portions 31 extending over the beam 16.

Figure 4:
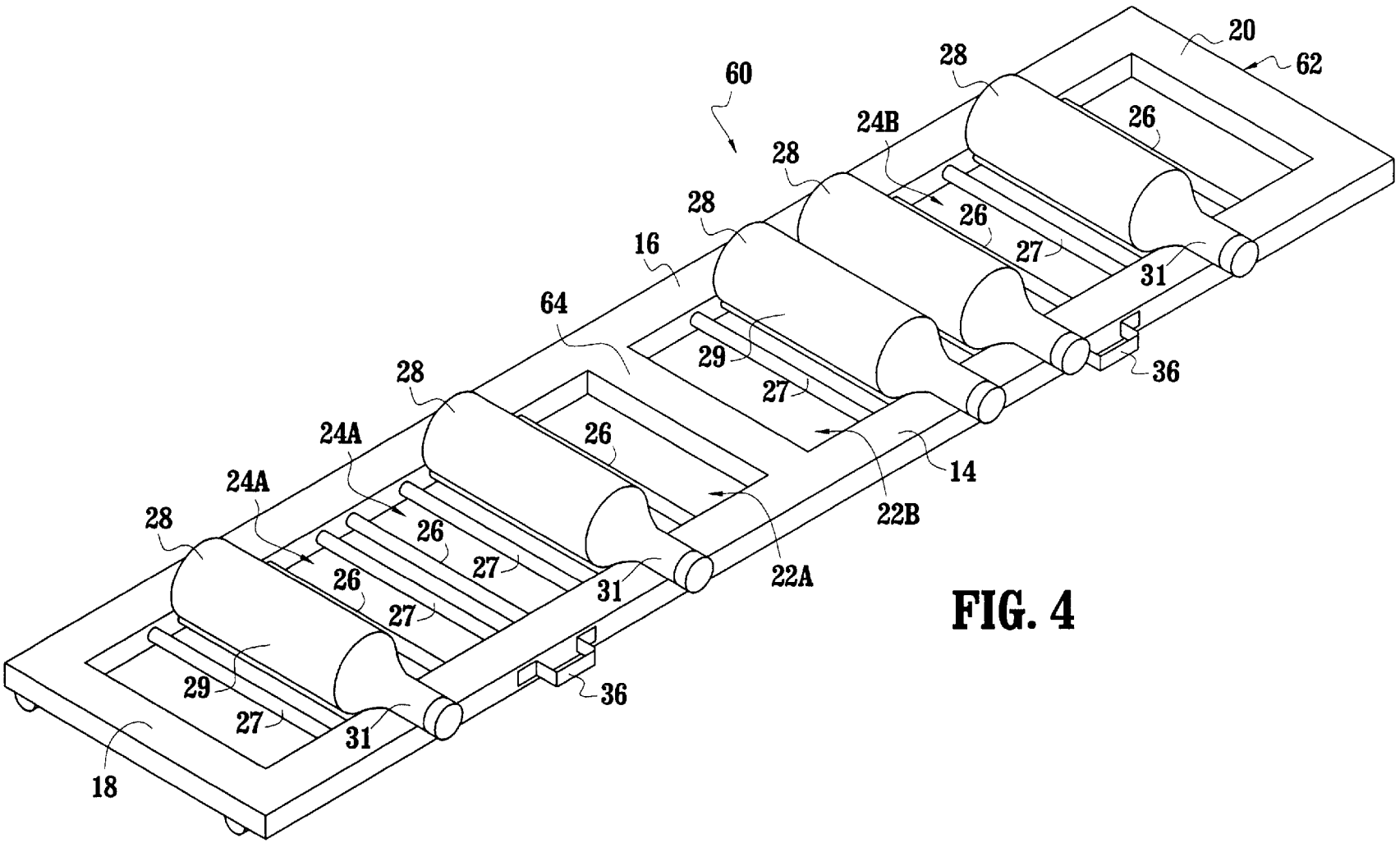
FIG. 4 is an isometric view of a mobile low-profile storage rack according to a third embodiment of the invention.

With reference now to FIG. 4 a low-profile mobile storage rack 60 according to a third embodiment of the invention is illustrated, wherein like parts in the previous embodiments are represented by like numerals. The rack 60 includes a frame 62 with longitudinal beams 14, 16 and cross beams 18, 20 connected to the ends of the longitudinal beams. A middle cross beam 64 is preferably centrally located between and substantially parallel to the cross beams 18, 20, and extends between the longitudinal beams 14, 16. The middle cross beam 64 together with the beams 14–20 form two openings 22A and 22B.

First sets 24A of rods 26 and 27 extend in the opening 22A between the longitudinal beams 14 and 16. Likewise, second sets 24B of rods 26 and 27 extend in the opening 22B between the longitudinal beams 14 and 16.

Each opening 22A, 22B is preferably similar in shape and dimension to the opening 22 in the FIG. 1 embodiment, so that the main portion 29 of the bottles 28 are coincident with the openings 22A, 22B while the neck portion 31 extends over one of the longitudinal beams 14, 16.

In each of the above embodiments, additional bottles may be stacked between adjacent underlying bottles if storage space permits.

In use, one or more bottles, cans, or other containers or items may be positioned on the rack 10, 50, 60 over a set 24, 24A, 24B of rods 26 and 27. The rack may then be rolled to a storage position under a bed, dresser, desk, or other furniture or the like, by grasping the handle(s) 36 and/or other part of the rack. When it is desirous to retrieve the item stored on the rack, the handle(s) and/or other part of the rack may be grasped and pulled to roll the rack from the storage position to an access position.

While the invention has been taught with specific reference to the above-described embodiments, those skilled in the art will recognize that changes can be made in form and detail without departing from the spirit and the scope of the invention. The scope of the invention is, therefore, indicated by the appended claims rather than by the foregoing description. All changes that come within the meaning and range of equivalency of the claims are to be embraced within their scope.

What is claimed is:

1. A low-profile storage rack for supporting and storing containers thereon, comprising:

a frame having:

a first longitudinal beam;

a second longitudinal beam, the second longitudinal beam being spaced from the first longitudinal beam; and at least a first transverse beam connected to the first and second longitudinal beams;

each of the longitudinal and transverse beams having a width, and a height that is less than the width; and a plurality of first sets of rods extending from one of the first and second longitudinal beams toward the other of the first and second longitudinal beams, a distance between adjacent first sets of rods being less than a distance between adjacent rods of each first set such that said containers can be supported on adjacent first set of rods.

2. A low-profile storage rack according to claim 1, and further comprising a plurality of wheels mounted to an underside of the frame.

3. A low-profile storage rack according to claim 1, and further comprising a second transverse beam spaced from the first transverse beam and connected to the first and second longitudinal beams, the longitudinal and transverse beams together forming a first elongate opening.

4. A low-profile storage rack according to claim 3, wherein the plurality of first sets of rods are positioned in the first elongate opening.

5. A low-profile storage rack according to claim 3, and further comprising a third longitudinal beam spaced from the second longitudinal beam and extending between the first and second transverse beams to thereby form a second elongate opening separated from the first elongate opening by the second longitudinal beam.

6. A low-profile storage rack according to claim 5, and further comprising at least one second set of rods, with the plurality of first sets of rods extending between the first and second longitudinal beams in the first elongate opening and the at least one second set of rods extending between the second and third longitudinal beams in the second elongate opening.

7. A low-profile storage rack according to claim 6, and further in combination with first and second containers, each container having a body portion and a neck portion extending from the body portion, wherein a first distance between the first and second longitudinal beams and a second distance between the second and third longitudinal beams are less than a length of the first and second containers, respectively, such that the container body portion of the first container is supported on the rods of one of the first sets with the container neck portion of the first container extending over the first longitudinal beam, and the container body portion of the second container is supported on the rods of the at least one second set with the neck portion of the second container extending over the third longitudinal beam.

8. A low-profile storage rack according to claim 3, and further comprising a third transverse beam spaced from the second transverse beam and extending between the first and second longitudinal beams to thereby form a second elongate opening separated from the first elongate opening by the second transverse beam.

9. A low-profile storage rack according to claim 8 wherein the longitudinal and transverse beams are located in a common plane.

10. A low-profile storage rack according to claim 8, and further comprising at least one second set of rods extending between the first and second longitudinal beams, with the plurality of first sets of rods located in the first elongate opening and the at least one second set of rods located in the second elongate opening.

11. A low-profile storage rack according to claim 10, wherein the at least one second set of rods comprises a plurality of second sets of rods, with a distance between adjacent second set of rods being less than a distance between adjacent rods of each second set.

12. A low-profile storage rack according to claim 1, wherein each of the rods is generally circular in cross section.

13. A low-profile storage rack for supporting and storing a plurality of containers thereon, each of the containers including a main body portion and a neck portion, the storage rack comprising:

a frame having:

a first longitudinal beam;

a second longitudinal beam, the second longitudinal beam being spaced from the first longitudinal beam;

a first transverse beam connected to the first and second longitudinal beams; and a second transverse beam spaced from the first transverse beam and connected to the first and second longitudinal beams, the longitudinal and transverse beams together forming a first elongate opening;

each of the longitudinal and transverse beams having a width, and a height that is less than the width; and a plurality of first sets of rods located in the first elongate opening and extending from one of the first and second longitudinal beams toward the other of the first and second longitudinal beams, a distance between adjacent first sets of rods being less than a distance between adjacent rods of each first set such that the main body portions of adjacent containers can be supported on adjacent first sets of rods.

14. A low-profile storage rack according to claim 13, and further comprising a plurality of wheels mounted to an underside of the frame.

15. A low-profile mobile storage rack according to claim 13, and further comprising a third longitudinal beam spaced from the second longitudinal beam and extending between the first and second transverse beams to thereby form a second elongate opening that is separated from the first elongate opening by the second longitudinal beam.

16. A low-profile storage rack according to claim 15, wherein the first sets of rods extend between the first and second longitudinal beams in the first elongate opening and further comprising a plurality of second sets of rods extending between the second and third longitudinal beams in the second elongate opening.

17. A low-profile storage rack according to claim 16, and further in combination with first and second containers, each container having a body portion and a neck portion extending from the body portion, wherein a first distance between the first and second longitudinal beams and a second distance between the second and third longitudinal beams are less than a length of the first and second containers, respectively, such that the container body portion of the first container is supported on the rods of one of the first sets with the container neck portion of the first container extending over the first longitudinal beam and the container body portion of the second container is supported on the rods of one of the second sets with the container neck portion of the second container extending over the third longitudinal beam.

18. A low-profile storage rack according to claim 13, and further comprising a third transverse beam spaced from the second transverse beam and extending between the first and second longitudinal beams to thereby form a second elongate opening separated from the first elongate opening by the second transverse beam.

19. A low-profile storage rack according to claim 18, wherein the first sets of rods extend between the first and second longitudinal beams in the first elongate opening, and further comprising a plurality of second sets of rods extending between the first and second longitudinal beams in the second elongate opening.

20. In combination, a low-profile storage rack and at least first and second containers supported thereon, comprising:

a frame having:

a first longitudinal beam;

a second longitudinal beam spaced from the first longitudinal beam;

a third longitudinal beam spaced from the second longitudinal beam;

first and second transverse beam connected to opposite ends of the first, second and third longitudinal beams to thereby form first and second openings separated by the second longitudinal beam;

each of the longitudinal and transverse beams having a width, and a height that is less than the width;

at least one first set of rods extending between the first and second longitudinal beams in the first opening; and at least one second set of rods extending between the second and third longitudinal beams in the second opening; and each of the containers having a body portion and a neck portion extending from the body portion, wherein a first distance between the first and second longitudinal beams and a second distance between the second and third longitudinal beams are less than a length of the first and second containers, respectively, such that the container body portion of the first container is supported on the rods of the first set with the container neck portion of the first container extending over the first longitudinal beam, and the container body portion of the second container is supported on the rods of the second set with the neck portion of the second container extending over the third longitudinal beam.

* * * * *